US009899118B2

(12) United States Patent
Yoshida et al.

(10) Patent No.: US 9,899,118 B2
(45) Date of Patent: Feb. 20, 2018

(54) ALUMINUM ALLOY WIRE ROD, ALLUMINUM ALLOY STRANDED WIRE, COATED WIRE, WIRE HARNESS, METHOD OF MANUFACTURING ALUMINUM ALLOY WIRE ROD, AND METHOD OF MEASURING ALUMINUM ALLOY WIRE ROD

(71) Applicants: FURUKAWA ELECTRIC CO., LTD., Tokyo (JP); FURUKAWA AUTOMOTIVE SYSTEMS INC., Inukami-gun, Shiga (JP)

(72) Inventors: Sho Yoshida, Tokyo (JP); Shigeki Sekiya, Tokyo (JP); Kengo Mitose, Tokyo (JP)

(73) Assignees: FURUKAWA ELECTRIC CO., LTD., Tokyo (JP); FURUKAWA AUTOMOTIVE SYSTEMS INC., Shiga (JP)

( * ) Notice: Subject to any disclaimer, the term of this patent is extended or adjusted under 35 U.S.C. 154(b) by 0 days.

(21) Appl. No.: 15/244,177

(22) Filed: Aug. 23, 2016

(65) Prior Publication Data

US 2016/0358685 A1 Dec. 8, 2016

Related U.S. Application Data

(63) Continuation of application No. PCT/JP2014/079033, filed on Oct. 31, 2014.

(30) Foreign Application Priority Data

Mar. 6, 2014 (JP) ..... 2014-044439
Sep. 11, 2014 (JP) ..... 2014-185382

(51) Int. Cl.

| | |
|---|---|
| ***H01B 7/00*** | (2006.01) |
| ***H01B 5/08*** | (2006.01) |
| ***C22C 21/04*** | (2006.01) |
| ***C22C 21/06*** | (2006.01) |
| ***C22C 21/08*** | (2006.01) |
| ***H01B 1/02*** | (2006.01) |
| ***C22C 21/00*** | (2006.01) |
| ***C22F 1/04*** | (2006.01) |
| ***C22C 21/02*** | (2006.01) |
| ***C22F 1/043*** | (2006.01) |
| ***H01B 5/02*** | (2006.01) |
| ***H01B 7/02*** | (2006.01) |
| ***H01B 13/00*** | (2006.01) |
| ***H01R 11/11*** | (2006.01) |
| *C22F 1/00* | (2006.01) |

(52) U.S. Cl.

CPC ..... *H01B 1/023* (2013.01); *C22C 21/00* (2013.01); *C22C 21/02* (2013.01); *C22F 1/04* (2013.01); *C22F 1/043* (2013.01); *H01B 5/02* (2013.01); *H01B 5/08* (2013.01); *H01B 7/0045* (2013.01); *H01B 7/02* (2013.01); *H01B 13/0016* (2013.01); *H01B 13/0036* (2013.01); *H01R 11/11* (2013.01); *C22F 1/00* (2013.01)

(58) Field of Classification Search

CPC .. H01B 1/02; H01B 1/023; H01B 5/02; C22C 21/00; C22C 21/02; C22C 21/08; C22C 21/14

USPC ..... 174/72 A, 110 R, 128.1; 420/544, 546, 420/535; 428/544

See application file for complete search history.

(56) References Cited

U.S. PATENT DOCUMENTS

| | | | | |
|---|---|---|---|---|
| 3,843,418 | A * | 10/1974 | Oida et al. | C22C 21/08 148/415 |
| 4,042,424 | A * | 8/1977 | Nicoud | C22C 21/08 148/417 |
| 2003/0143102 | A1* | 7/2003 | Matsuoka | C22C 21/04 420/546 |
| 2006/0013719 | A1* | 1/2006 | Ichikawa | C22C 21/10 419/29 |

(Continued)

FOREIGN PATENT DOCUMENTS

| | | |
|---|---|---|
| CN | 103572103 A | 2/2014 |
| JP | 2000-273567 A | 10/2000 |

(Continued)

OTHER PUBLICATIONS

English Translation of the International Preliminary Report on Patentability (Form PCT/IB/373) and Written Opinion of the International Searching Authority (Form PCT/ISA/237), dated Sep. 6, 2016, for International Application No. PCT/JP2014/079033.

(Continued)

*Primary Examiner* — Timothy Thompson
*Assistant Examiner* — Rhadames J Alonzo Miller
(74) *Attorney, Agent, or Firm* — Birch, Stewart, Kolasch & Birch, LLP

(57) ABSTRACT

An aluminum alloy wire rod has a composition including Mg: 0.10-1.0 mass %, Si: 0.10-1.20 mass %, Fe: 0.01-1.40 mass %, Ti: 0.000-0.100 mass %, B: 0.000-0.030 mass %, Cu: 0.00-1.00 mass %, Ag: 0.00-0.50 mass %, Au: 0.00-0.50 mass %, Mn: 0.00-1.00 mass %, Cr: 0.00-1.00 mass %, Zr: 0.00-0.50 mass %, Hf: 0.00-0.50 mass %, V: 0.00-0.50 mass %, Sc: 0.00-0.50 mass %, Co: 0.00-0.50 mass %, Ni: 0.00-0.50 mass %, and the balance: Al and incidental impurities, Mg/Si mass ratio being 0.4 to 0.8. The aluminum alloy wire rod has a tensile strength of greater than or equal to 200 MPa, an elongation of greater than or equal to 13%, a conductivity of 47% IACS, and a ratio (YS/TS) of 0.2% yield strength (YS) to the tensile strength (TS) of less than or equal to 0.7.

35 Claims, 1 Drawing Sheet

(56) References Cited

U.S. PATENT DOCUMENTS

| | | | | |
|---|---|---|---|---|
| 2007/0221396 | A1* | 9/2007 | Izumida | C21D 8/06 174/128.1 |
| 2008/0196923 | A1* | 8/2008 | Susai | C22C 21/00 174/110 R |
| 2010/0059151 | A1* | 3/2010 | Iwamura | C22C 21/12 148/690 |
| 2010/0071933 | A1* | 3/2010 | Otsuka | C21D 9/60 174/128.1 |
| 2011/0132659 | A1* | 6/2011 | Kusakari | B21C 1/00 174/72 A |
| 2012/0118607 | A1* | 5/2012 | Ishibashi | C22C 21/00 174/126.1 |
| 2013/0264115 | A1* | 10/2013 | Kobayashi | H01B 1/023 174/72 A |
| 2014/0367001 | A1 | 12/2014 | Inagaki et al. | |
| 2015/0007910 | A1 | 1/2015 | Sekiya et al. | |

FOREIGN PATENT DOCUMENTS

| | | | |
|---|---|---|---|
| JP | 2001-254160 | A | 9/2001 |
| JP | 2003-027170 | A | 1/2003 |
| JP | 2012-229485 | A | 11/2012 |
| JP | 2013-044038 | A | 3/2013 |
| JP | 5367926 | B1 | 12/2013 |
| WO | WO 2013/114928 | A1 | 8/2013 |
| WO | WO 2013/147270 | A1 | 10/2013 |

OTHER PUBLICATIONS

International Search Report (PCT/ISA/210) issued in PCT/JP2014/079033, dated Feb. 3, 2015.

Written Opinion (PCT/ISA/237) issued in PCT/JP2014/079033, dated Feb. 3, 2015.

Extended European Search Report issued in European Application No. 14884578.7 dated Oct. 10, 2017.

Martinova et al., "The Effect of Room Temperature Pre-Ageing on Tensile and Electrical Properties of Thermomechanically Treated Al—Mg—Si Alloy," Journal of Mining and Metallurgy Section: B, vol. 38, No. 1-2, Jan. 2002, XP055409839, pp. 61-73.

Zhen et al., "DSC analyses of the precipitation behavior of two Al—Mg—Si alloys naturally aged for different times," Materials Letters, vol. 37, Dec. 1, 1998, XP004256042, pp. 349-353.

Chinese Office Action and Search Report issued in Chinese Application No. 201480075812.0 dated Oct. 31, 2017, together with an English translation.

* cited by examiner

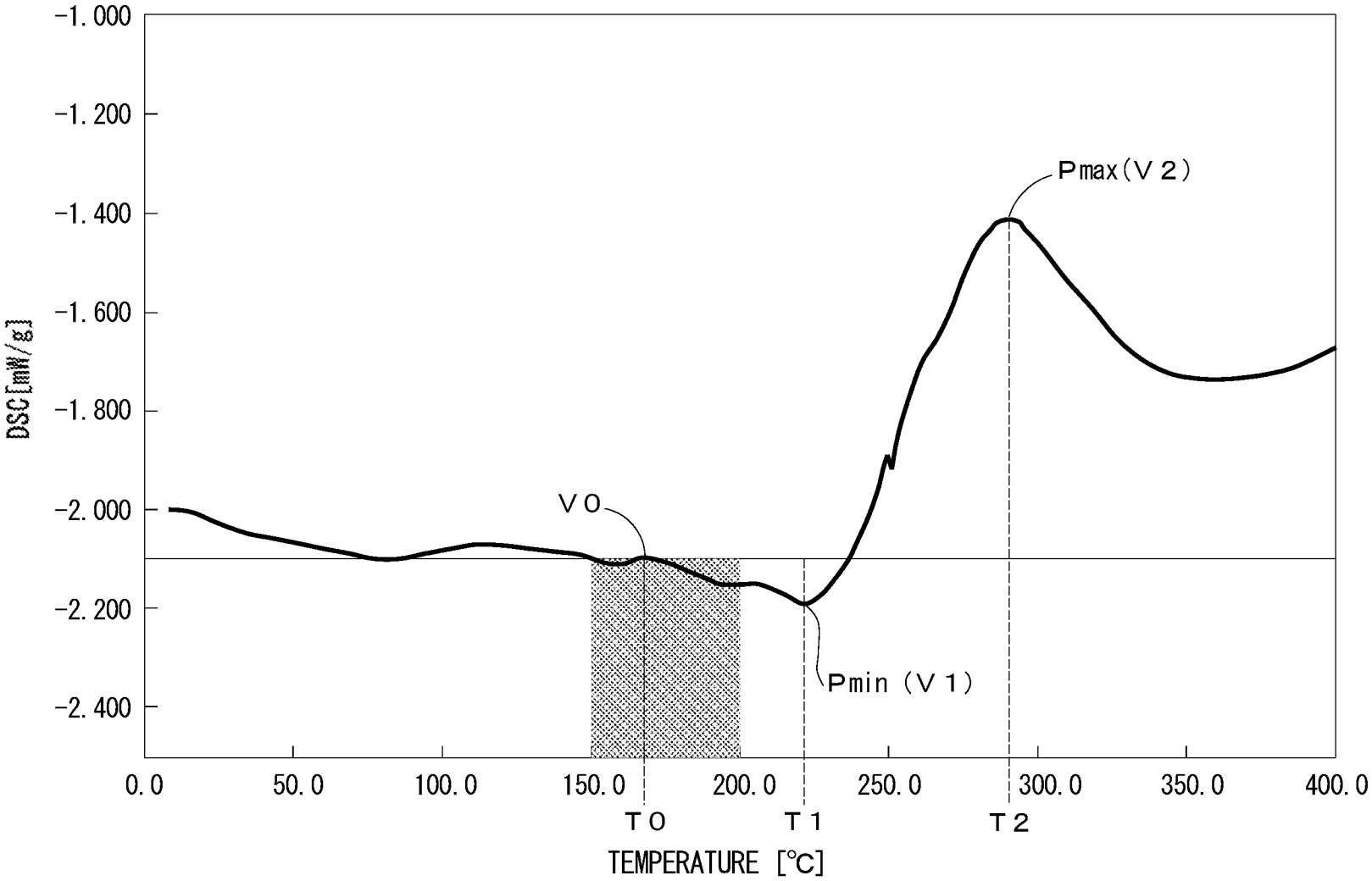
Pmax（V 2）
Pmin（V 1）
V O
T O
T 1
T 2
TEMPERATURE [°C]
DSC[mW/g]
-1.000
-1.200
-1.400
-1.600
-1.800
-2.000
-2.200
-2.400
0.0
50.0
100.0
150.0
200.0
250.0
300.0
350.0
400.0

ALUMINUM ALLOY WIRE ROD, ALLUMINUM ALLOY STRANDED WIRE, COATED WIRE, WIRE HARNESS, METHOD OF MANUFACTURING ALUMINUM ALLOY WIRE ROD, AND METHOD OF MEASURING ALUMINUM ALLOY WIRE ROD

CROSS REFERENCE TO RELATED APPLICATIONS

This is a continuation application of International Patent Application No. PCT/JP2014/079033 filed Oct. 31, 2014, which claims the benefit of Japanese Patent Application No. 2014-044439 and 2014-185382, filed Mar. 6, 2014 and Sep. 11, 2014, respectively, the full contents of all of which are hereby incorporated by reference in their entirety.

BACKGROUND

Technical Field

The present disclosure relates to an aluminum alloy wire rod used as a conductor of an electric wiring structure, an aluminum alloy stranded wire, a coated wire, and a wire harness, as well as, a method of manufacturing an aluminum alloy wire rod and a method of measuring an aluminum alloy wire rod, and particularly relates to an aluminum alloy wire rod that has a low 0.2% yield strength to tensile strength while ensuring a good balance between tensile strength, elongation and conductivity, even if used as an extra fine wire having a wire diameter of less than or equal to 0.5 mm.

Background Art

In the related art, a so-called wire harness has been used as an electric wiring structure for mobile bodies such as automobiles, trains, and aircrafts, or an electric wiring structure for industrial robots. A wire harness is a member including electric wires each having a conductor made of copper or copper alloy and fitted with terminals (connectors) made of copper or copper alloy (e.g., brass). With recent rapid advancements in performances and functions of automobiles, various electrical devices and control devices installed in mobile bodies tend to increase in number and electric wiring structures used for the devices also tend to increase in number. On the other hand, for environmental friendliness, lightweighting of mobile bodies is strongly desired for improving fuel efficiency of mobile bodies such as automobiles.

As one of the measures for achieving lightweighting of mobile bodies, there have been, for example, continuous efforts in the studies on a conductor of an electric wiring structure to replace conventionally used copper or copper alloys with aluminum or aluminum alloys, which is more lightweighted. Since aluminum has a specific gravity of about one-third of a specific gravity of copper, and has a conductivity of about two-thirds of a conductivity of copper (in a case where pure copper is a standard for 100% IACS, pure aluminum has approximately 66% IACS), an aluminum conductor wire rod needs to have a cross sectional area of approximately 1.5 times greater than a cross sectional area of a copper conductor wire rod to allow the same electric current as the electric current flowing through the copper conductor wire rod to flow through the aluminum conductor wire rod. Even an aluminum conductor wire rod having an increased cross section as described above is used, using an aluminum conductor wire rod is advantageous from the viewpoint of lightweighting, since an aluminum conductor wire rod has a mass of about half the mass of a pure copper conductor wire rod. Note that, "% IACS" represents a conductivity when a resistivity $1.7241\times10^{-8}$ Ωm of International Annealed Copper Standard is taken as 100% IACS.

However, it is known that a pure aluminum wire rod, typically an aluminum alloy wire rod for transmission lines (JIS (Japanese Industrial Standard) A1060 and A1070), is generally poor in its durability to tension, resistance to impact, and bending characteristics. Therefore, for example, it cannot withstand a load abruptly applied by an operator or an industrial device while being installed to a car body, a tension at a crimp portion of a connecting portion between an electric wire and a terminal, and a cyclic stress loaded at a bending portion such as a door portion. On the other hand, an alloyed material containing various additive elements added thereto is capable of achieving an increased tensile strength, but a conductivity may decrease due to a solid solution phenomenon of the additive elements into aluminum, and because of excessive intermetallic compounds formed in aluminum, a wire break due to the intermetallic compounds may occur during wire drawing. Therefore, it is essential to limit or select additive elements to provide sufficient elongation characteristics to prevent a wire break, and it is further necessary to ensure conductivity and a tensile strength equivalent to those in the related art.

As a high strength aluminum alloy wire rod, for example, an aluminum alloy wire rod containing Mg and Si is known, and a 6000-series aluminum alloy (Al—Mg—Si based alloy) wire rod is a typical example of such aluminum alloy wire rod. Generally, as for the 6000-series aluminum alloy wire rod, the strength can be increased by applying a solution heat treatment and an aging treatment. However, in a case where an extra fine wire such as a wire having a wire diameter of less than or equal to 0.5 mm is manufactured using a 6000-series aluminum alloy wire rod, although a high strength can be achieved by applying a solution heat treatment and an aging treatment, there was a tendency that a work efficiency for attaching to a car body decreases because of a large force required for plastic deformation due to an increase in a yield strength (0.2% yield strength).

A conventional 6000-series aluminum alloy wire used for an electric wiring structure of a mobile bodies is described, for example, in Japanese Laid-Open Patent Publication No. 2012-229485. The aluminum alloy wire described in Japanese Laid-Open Patent Publication No. 2012-229485 is an extra fine wire that achieves an aluminum alloy wire having an improved elongation while having a high strength and a high conductivity. In Japanese Laid-Open Patent Publication No. 2012-229485, it is described that a good conductivity, tensile strength, and elongation can be obtained by using finer crystal grain size, but fails to disclose or suggest that a high strength and a low yield strength are achieved simultaneously.

The present disclosure is related to providing an aluminum alloy wire rod used as a conductor of an electric wiring structure, the aluminum alloy wire having a low 0.2% yield strength (YS) to tensile strength (TS) while ensuring a good balance between tensile strength, elongation and conductivity, even if used as an extra fine wire having a wire diameter of less than or equal to 0.5 mm, as well as an aluminum alloy stranded wire, a coated wire, and a wire harness, and to provide a method of manufacturing such an aluminum alloy wire rod and a method of measuring such an aluminum alloy wire rod.

The inventors have found that, based on the premise that an aluminum alloy containing Mg and Si is used, an aluminum alloy wire rod having a low 0.2% yield strength to tensile strength while ensuring a good balance between tensile strength, elongation and conductivity can be obtained with a predetermined component composition and by controlling the manufacturing process, and have completed the present disclosure. Further, it was found that production of solute atom clusters is involved in the mechanism of the present disclosure, and the disclosure can be specified by the presence of said solute atom cluster.

SUMMARY

According to a first aspect of the present disclosure, an aluminum alloy wire rod has a composition comprising Mg: 0.10 mass % to 1.0 mass %, Si: 0.10 mass % to 1.20 mass %, Fe: 0.01 mass % to 1.40 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, the aluminum alloy wire rod having a tensile strength of greater than or equal to 200 MPa, an elongation of greater than or equal to 13%, a conductivity of 47% IACS, and a ratio (YS/TS) of 0.2% yield strength (YS) to the tensile strength (TS) of less than or equal to 0.7.

According to a second aspect of the present disclosure, a wire harness includes: a coated wire including a coating layer at an outer periphery of one of an aluminum alloy wire rod and an aluminum alloy stranded wire; and a terminal fitted at an end portion of the coated wire, the coating layer being removed from the end portion, wherein the aluminum alloy wire rod has a composition comprising Mg: 0.10 mass % to 1.0 mass %, Si: 0.10 mass % to 1.20 mass %, Fe: 0.01 mass % to 1.40 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, the aluminum alloy wire rod having a tensile strength of greater than or equal to 200 MPa, an elongation of greater than or equal to 13%, a conductivity of 47% IACS, and a ratio (YS/TS) of 0.2% yield strength (YS) to the tensile strength (TS) of less than or equal to 0.7.

According to a third aspect of the present disclosure, a method of manufacturing an aluminum alloy wire rod having a composition comprising Mg: 0.10 mass % to 1.0 mass %, Si: 0.10 mass % to 1.20 mass %, Fe: 0.01 mass % to 1.40 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, the aluminum alloy wire rod having a tensile strength of greater than or equal to 200 MPa, an elongation of greater than or equal to 13%, a conductivity of 47% IACS, and a ratio (YS/TS) of 0.2% yield strength (YS) to the tensile strength (TS) of less than or equal to 0.7, includes: forming a drawing stock through hot working subsequent to melting and casting, and thereafter carrying out processes including at least a wire drawing process, a solution heat treatment process and an aging heat treatment process, the solution heat treatment process including heating to a predetermined temperature in a range of 450° C. to 540° C. at a temperature increasing rate of greater than or equal to 100° C./s, retaining for a retention time of 30 seconds or less, and thereafter cooling at an average cooling rate of greater than or equal to 10° C./s at least to a temperature of 150° C., and the aging heat treatment process including heating to a predetermined temperature in a range of 20° C. to 150° C. at a temperature increasing temperature in a range of 20° C./s to 100° C./s.

According to a fourth aspect of the present disclosure, an aluminum alloy wire rod has a composition comprising Mg: 0.10 mass % to 1.00 mass %, Si: 0.10 mass % to 1.20 mass %, Fe: 0.01 mass % to 0.70 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, a solute atom cluster being present in the aluminum alloy wire rod.

According to a fifth aspect of the present disclosure, a wire harness includes: a coated wire including a coating layer at an outer periphery of one of an aluminum alloy wire rod and an aluminum alloy stranded wire; and a terminal fitted at an end portion of the coated wire, the coating layer being removed from the end portion, wherein the aluminum alloy wire rod has a composition comprising Mg: 0.10 mass % to 1.00 mass %, Si: 0.10 mass % to 1.20 mass %, Fe: 0.01 mass % to 0.70 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, a solute atom cluster being present in the aluminum alloy wire rod.

According to a sixth aspect of the present disclosure, a method of manufacturing an aluminum alloy wire rod having a composition comprising Mg: 0.10 mass % to 1.00 mass %, Si: 0.10 mass % to 1.20 mass %, Fe: 0.01 mass % to 0.70 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, a solute atom cluster being present in the aluminum alloy wire rod, includes forming a drawing stock through hot working subsequent to melting, casting, and homogenizing heat treatment, and thereafter carrying out processes including at least a wire drawing process, a solution heat treatment process and an aging heat treatment process, the solution heat treatment process including heating to a predetermined temperature in a range of 450° C. to 600° C. at a temperature increasing rate of greater than or equal to 10° C./s, and thereafter cooling at an average cooling rate of greater than or equal to 10° C./s at least to a temperature of 150° C., and the aging heat treatment process including heating to a predetermined temperature in a range of 20° C. to 150° C. at a temperature increasing temperature in a range of 0.5° C./s to 130° C./s.

According to a seventh aspect of the present disclosure, an aluminum alloy wire rod has a composition comprising Mg: 0.10 mass % to 1.00 mass %, Si: 0.10 mass % to 1.20 mass %, Fe: 0.01 mass % to 0.70 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, a Differential Scanning calorimetry curve having an endothermic peak corresponding to fusion of a solute atom cluster.

According to an eighth aspect of the present disclosure, a wire harness includes: a coated wire including a coating layer at an outer periphery of one of aluminum alloy wire rod and an aluminum alloy stranded wire; and a terminal fitted at an end portion of the coated wire, the coating layer being removed from the end portion, wherein the aluminum alloy wire rod has a composition comprising Mg: 0.10 mass % to 1.00 mass %, Si: 0.10 mass % to 1.20 mass %, Fe: 0.01 mass % to 0.70 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, a Differential Scanning calorimetry curve having an endothermic peak corresponding to fusion of a solute atom cluster.

According to a ninth aspect of the present disclosure, a method of manufacturing an aluminum alloy wire rod having a composition comprising Mg: 0.10 mass % to 1.00 mass %, Si: 0.10 mass % to 1.20 mass %, Fe: 0.01 mass % to 0.70 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, a Differential Scanning calorimetry curve having an endothermic peak corresponding to fusion of a solute atom cluster, includes forming a drawing stock through hot working subsequent to melting, casting, and homogenizing heat treatment, and thereafter carrying out processes including at least a wire drawing process, a solution heat treatment process and an aging heat treatment process, the solution heat treatment process including heating to a predetermined temperature in a range of 450° C. to 600° C. at a temperature increasing rate of greater than or equal to 10° C./s, and thereafter cooling at an average cooling rate of greater than or equal to 10° C./s at least to a temperature of 150° C., and the aging heat treatment process including heating to a predetermined temperature in a range of 20° C. to 150° C. at a temperature increasing temperature in a range of 0.5° C./s to 130° C./s.

According to a tenth aspect of the present disclosure, a method of measuring an aluminum alloy wire rod having a composition comprising Mg: 0.10 mass % to 1.0 mass %, Si: 0.10 mass % to 1.20 mass %, Fe: 0.01 mass % to 1.40 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, is provided, wherein on a Differential Thermal Analysis curve, a maximum amount of heat in a range of 150° C. to 200° C. is taken as a reference amount of heat, and an absolute value of a difference between the reference amount of heat and a minimum amount of heat corresponding to an endothermic peak in a range of 150° C. to 250° C. is defined as a solute atom cluster production amount, and an absolute value of a difference between the reference amount of heat and a maximum amount of heat corresponding to an endothermic peak in a range of 200° C. to 350° C. is defined as a β"-phase production amount.

According to an aluminum alloy wire rod of the present disclosure, with the definitions described above, it is possible to provide an aluminum alloy wire rod used as a conductor of an electric wiring structure, an aluminum alloy stranded wire, a coated wire, and a wire harness, having a low 0.2% yield strength (YS) to tensile strength (TS) while ensuring a good balance between tensile strength, elongation and conductivity, even if used as an extra fine wire having a wire diameter of less than or equal to 0.5 mm, and to provide a method of manufacturing an aluminum alloy wire rod and a method of measuring an aluminum alloy wire rod. Such an aluminum alloy wire rod of the present disclosure is useful as a battery cable, a harness or a lead-wire for motors installed on mobile bodies, or a wiring body of industrial robots. Furthermore, an aluminum alloy wire rod of the present disclosure has a moderately high tensile strength, and thus the wire size of can be made smaller than those of conventional electric wires.

BRIEF DESCRIPTION OF DRAWINGS

FIG. 1 is a diagram for explaining methods of analyzing and measuring solute atom clusters and a β"-phase in an aluminum alloy wire rod of the present disclosure.

DETAILED DESCRIPTION

Further features of the present disclosure will become apparent from the following detailed description of exemplary embodiments with reference to the accompanying drawing.

An aluminum alloy wire rod of an embodiment of the present disclosure (hereinafter referred to as a present embodiment) has a composition comprising Mg: 0.10 mass % to 1.00 mass %, Si: 0.10 mass % to 1.20 mass %, Fe: 0.01 mass % to 1.40 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, aluminum alloy wire rod having a tensile strength of greater than or equal to 250 MPa, an elongation of greater than or equal to 13%, a conductivity of 47% IACS, and a ratio of 0.2% yield strength to the strength of less than or equal to 0.7.

Further, an aluminum alloy wire rod of the present embodiment is an aluminum alloy wire rod having a composition comprising Mg: 0.10 mass % to 1.00 mass %, Si: 0.10 mass % to 1.20 mass %, Fe: 0.01 mass % to 0.70 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, a solute atom cluster being present in the aluminum alloy wire rod.

Herein, a solute atom cluster refers to an aggregate obtained by cohesion of solute atoms, and, for example, in the present embodiment, a cluster such as a Si—Si cluster or a Mg—Si cluster is produced.

Hereinafter, reasons for limiting a chemical composition or the like of the aluminum alloy wire rod of the present embodiment will be described.

(1) Chemical Composition

<Mg: 0.10 Mass % to 1.00 Mass %>

Mg (magnesium) has an effect of strengthening by forming a solid solution in an aluminum base material, and a part of it has an effect of improving a tensile strength by being precipitated as a β"-phase (beta double prime phase) or the like together with Si. In a case where it forms an Mg—Si cluster as a solute atom cluster, it is an element having an effect of improving a tensile strength and an elongation. However, in a case where Mg content is less than 0.10 mass %, the above effects are insufficient. In a case where Mg content is in excess of 1.00 mass %, there is an increased possibility of formation of an Mg-concentration part on a grain boundary, which may cause a decrease in tensile strength and elongation, as well as an increase in a yield strength, and thus an ease of routing and handling decreases. Also, conductivity decreases due to an increased amount of solid solution of an Mg element. Accordingly, the Mg content is 0.10 mass % to 1.00 mass %. The Mg content is, when a high strength is of importance, preferably 0.50 mass % to 1.00 mass %, and in case where a conductivity is of importance, preferably 0.10 mass % to 0.50 mass %. Based on the points described above, 0.30 mass % to 0.70 mass % is generally preferable.

<Si: 0.10 Mass % to 1.20 Mass %>

Si (silicon) has an effect of strengthening by forming a solid solution in an aluminum base material, and a part of it has an effect of improving a tensile strength and a bending fatigue resistance by being precipitated as a β"-phase (beta double prime phase) or the like together with Si. Also, in a case where it forms an Mg—Si cluster or a Si—Si cluster as a solute atom cluster, it is an element having an effect of improving a tensile strength and an elongation. However, in a case where Si content is less than 0.10 mass %, the above effects are insufficient. In a case where Si content is in excess of 1.00 mass %, there is an increased possibility of formation of an Si-concentration part on a grain boundary, which may cause a decrease in tensile strength and elongation, as well as an increase in yield strength, and thus an ease of routing and handling decreases. Also, conductivity decreases due to an increased amount of solid solution of an Si element. Accordingly, the Si content is 0.10 mass % to 1.20 mass %. The Si content is, when a high strength is of importance, preferably 0.50 mass % to 1.00 mass %, and in case where a conductivity is of importance, preferably 0.10 mass % to 0.50 mass %. Based on the points described above, 0.30 mass % to 0.70 mass % is generally preferable.

<Fe: 0.01 Mass % to 1.40 Mass %>

Fe (iron) is an element that contributes to refinement of crystal grains mainly by forming an Al—Fe based intermetallic compound and provides improved tensile strength. Fe dissolves in Al only by 0.05 mass % at 655° C., and even less at room temperature. Accordingly, the remaining Fe that cannot dissolve in Al will be crystallized or precipitated as an intermetallic compound such as Al—Fe, Al—Fe—Si, and Al—Fe—Si—Mg. This intermetallic compound contributes to refinement of crystal grains and provides improved tensile strength. Further, Fe has, also by Fe that has dissolved in Al, an effect of providing an improved tensile strength. In a case where Fe content is less than 0.01 mass %, those effects are insufficient. In a case where Fe content is in excess of 1.40 mass %, a wire drawing workability decreases due to coarsening of crystallized materials or precipitates, and also a yield strength increases, and thus an ease of routing and handling decreases. Also, a bending fatigue resistance and a conductivity decrease. Therefore, Fe content is 0.01 mass % to 1.40 mass %, and preferably 0.15 mass % to 0.70 mass %, and more preferably 0.15 mass % to 0.45 mass %.

The aluminum alloy wire rod of the present disclosure includes, as described above, Mg, Si and Fe as essential components, and may further contain at least one selected from a group comprising Ti and B, and/or at least one selected from a group comprising Cu, Ag, Au, Mn, Cr, Zr, Hf, V, Sc, Co and Ni, as necessary.

<Ti: 0.001 Mass % to 0.100 Mass %>

Ti is an element having an effect of refining the structure of an ingot during dissolution casting. In a case where an ingot has a coarse structure, the ingot may crack during casting or a wire break may occur during a wire rod processing step, which is industrially undesirable. In a case where Ti content is less than 0.001 mass %, the aforementioned effect cannot be achieved sufficiently, and in a case where Ti content is in excess of 0.100 mass %, the conductivity tends to decrease. Accordingly, the Ti content is 0.001 mass % to 0.100 mass %, preferably 0.005 mass % to 0.050 mass %, and more preferably 0.005 mass % to 0.030 mass %.

<B: 0.001 Mass % to 0.030 Mass %>

Similarly to Ti, B is an element having an effect of refining the structure of an ingot during dissolution casting. In a case where an ingot has a coarse structure, the ingot may crack during casting or a wire break is likely to occur during a wire rod processing step, which is industrially undesirable. In a case where B content is less than 0.001 mass %, the aforementioned effect cannot be achieved sufficiently, and in a case where B content in excess of 0.030 mass %, the conductivity tends to decrease. Accordingly, the B content is 0.001 mass % to 0.030 mass %, preferably 0.001 mass % to 0.020 mass %, and more preferably 0.001 mass % to 0.010 mass %.

To contain at least one selected from a group comprising <Cu: 0.01 mass % to 1.00 mass %>, <Ag: 0.01 mass % to 0.50 mass %>, <Au: 0.01 mass % to 0.50 mass %>, <Mn:

0.01 mass % to 1.00 mass %>, <Cr: 0.01 mass % to 1.00 mass %>, <Zr: 0.01 mass % to 0.50 mass %>, <Hf: 0.01 mass % to 0.50 mass %>, <V: 0.01 mass % to 0.50 mass %>, <Sc: 0.01 mass % to 0.50 mass %>, <Co: 0.01 mass % to 0.50 mass %>, and <Ni: 0.01 mass % to 0.50 mass %>.

Each of Cu, Ag, Au, Mn, Cr, Zr, Hf, V, Sc, Co and Ni is an element having an effect of refining crystal grains and suppressing the production of abnormal coarse growth grain, and Cu, Ag and Au are elements further having an effect of increasing a grain boundary strength by being precipitated at a grain boundary. In a case where at least one of the elements described above is contained by 0.01 mass % or more, the aforementioned effects can be achieved, and a tensile strength and an elongation can be further improved. On the other hand, in a case where any one of Cu, Ag, Au, Mn, Cr, Zr, Hf, V, Sc, Co and Ni has a content exceeding the upper limit thereof mentioned above, compounds containing these elements become coarse and degrades wire drawing workability, thus a wire break is likely to occur, and conductivity tends to decrease. Therefore, ranges of contents of Cu, Ag, Au, Mn, Cr, Zr, Hf, V, Sc, Co and Ni are the ranges described above, respectively. Among elements in this group of elements, it is particularly preferable to contain Ni. When Ni is contained, a crystal grain refinement effect and an abnormal grain growth suppressant effect become significant, and a tensile strength and elongation improve. Also, it becomes easier to suppress a decrease in conductivity and a wire break during wire drawing. It is further preferable that the content of Ni is 0.05 to 0.3 mass %, since this effect becomes significant.

As for Fe, Ti, B, Cu, Ag, Au, Mn, Cr, Zr, Hf, V, Sc, Co and Ni, the more the content of these elements, there is a tendency that the conductivity decreases, a tendency that the wire drawing workability decreases, and a tendency that the ease of routing and handling decreases due to an increase in the yield strength. Therefore, it is preferable that a total of the contents of the elements is less than or equal to 2.00 mass %. With the aluminum alloy wire rod of the present disclosure, since Fe is an essential element, a total of contents of Fe, Ti, B, Cu, Ag, Au, Mn, Cr, Zr, Hf, V, Sc, Co and Ni is 0.01 mass % to 2.00 mass %. It is further preferable that a total of contents of these elements is 0.10 mass % to 2.00 mass %. However, in a case where these elements are added alone, a compound containing the said elements tends to become coarse and thus deteriorates wire drawing workability and a wire break is likely to occur, the respective elements are within the content range specified above.

In order to moderately decrease a tensile strength, an elongation, and a value of yield strength to tensile strength, while maintaining a high conductivity, a total of contents of Fe, Ti, B, Cu, Ag, Au, Mn, Cr, Zr, Hf, V, Sc, Co and Ni is particularly preferably 0.01 mass % to 0.80 mass %, and further preferably 0.05 mass % to 0.60 mass %. On the other hand, in order to further decrease a tensile strength, an elongation and a value of yield strength to tensile strength, although the conductivity slightly decreases, it is particularly preferably more than 0.80 mass % to 2.00 mass %, and further preferably 1.00 mass % to 2.00 mass %.

<Balance: Al and Incidental Impurities>

The balance, i.e., components other than those described above, includes Al (aluminum) and incidental impurities. Herein, incidental impurities means impurities contained by an amount which could be contained inevitably during the manufacturing process. Since incidental impurities could cause a decrease in conductivity depending on a content thereof, it is preferable to suppress the content of the incidental impurities to some extent by taking the decrease in the conductivity into consideration. Components that may be incidental impurities include, for example, Ga, Zn, Bi, and Pb.

Also, in the present embodiment, the ratio (referred to as Mg/Si mass ratio) of Mg content (mass %) to Si content (mass %) is 0.4% to 0.8%. When the Mg/Si mass ratio is 0.4 to 0.8, the number of solute atom clusters increases due to the aging treatment, and a tensile strength and an elongation improve. Regarding the conductivity, solute atom clusters tend to slightly decrease, but it is not problematic since the conductivity of the matrix is sufficiently ensured with the composition of the present embodiment. Regarding the 0.2% yield strength, it is generally said that it increases along with an increase in the tensile strength, but such an effect can be suppressed due to the presence of solute atom clusters. In a case where the Mg/Si mass ratio is less than 0.4%, Si which does not contribute to solute atom clusters is present excessively and merely decreases the conductivity, and when it is in excess of 0.8%, solute atom clusters cannot be produced sufficiently.

Such an aluminum alloy wire rod can be obtained by combining and controlling alloy compositions and manufacturing processes. Hereinafter, a description is made of a preferred manufacturing method of an aluminum alloy wire rod of the present disclosure.

(Manufacturing Method of the Aluminum Alloy Wire Rod According to the Present Disclosure)

The aluminum alloy wire rod of the present disclosure can be manufactured through a manufacturing method including sequentially performing each process of [1] melting, [2] casting, [3] hot working (such as grooved roll working), [4] first wire drawing, [5] first heat treatment (intermediate heat treatment), [6] second wire drawing, [7] second heat treatment (solution heat treatment), and [8] third heat treatment (aging heat treatment). Note that a bundling step or a wire resin-coating step may be provided before or after the second heat treatment or after the aging heat treatment. Hereinafter, steps of [1] to [8] will be described.

[1] Melting

Melting is performed by adjusting quantities of each component such that the aforementioned aluminum alloy composition is obtained.

[2] Casting and [3] Hot Working (Such as Grooved Roll Working)

Subsequently, using a Properzi-type continuous casting rolling mill which is an assembly of a casting wheel and a belt, molten metal is cast with a water-cooled mold and rolling is performed continuously to obtain a bar having an appropriate size of, for example, 5 to 13 mm ϕ. A cooling rate during casting at this time is, in regard to preventing coarsening of Fe-based crystallized products and preventing a decrease in conductivity due to forced solid solution of Fe, preferably 1° C./s to 20° C./s, but it is not limited thereto. Casting and hot rolling may be performed by billet casting and an extrusion technique.

[4] First Wire Drawing

Subsequently, the surface is stripped and the bar is made into an appropriate size of, for example, 5 mm ϕ to 12.5 mm ϕ, and wire drawing is performed by cold rolling. It is preferable that a reduction ratio η is within a range of 1 to 6. The reduction ratio η is represented by:

$$\eta=\ln(A_0/A_1),$$

where $A_0$ is a wire rod cross sectional area before wire drawing and $A_1$ is a wire rod cross sectional area after wire drawing.

In a case where the reduction ratio η is less than 1, in a heat processing of a subsequent step, a recrystallized particle coarsens and a tensile strength and an elongation significantly decreases, which may cause a wire break. In a case where the reduction ratio η is greater than 6, the wire drawing becomes difficult and may be problematic from a quality point of view since a wire break might occur during a wire drawing process. The stripping of the surface has an effect of cleaning the surface, but does not need to be performed.

[5] First Heat Treatment (Intermediate Heat Treatment)

Then, a first heat treatment is applied to the work piece that has been subjected to cold drawing. The first heat treatment of the present disclosure is performed for regaining the flexibility of the work piece and for improving the wire drawing workability. It is not necessary to perform the first heat treatment if the wire drawing workability is sufficient and a wire break will not occur.

[6] Second Wire Drawing

After the first heat treatment, wire drawing is further carried out in a cold processing. During this, a reduction ratio η is preferably within a range of 1 to 6. The reduction ratio η has an influence on formation and growth of recrystallized grains. This is because, if the reduction ratio η less than 1, during the heat treatment in a subsequent step, there is a tendency that coarsening of recrystallized grains occur and the tensile strength and the elongation drastically decrease, and if the reduction ratio η is greater than 6, wire drawing becomes difficult and there is a tendency that problems arise in quality, such as a wire break during wire drawing. It is to be noted that in a case where the first heat treatment is not performed, the first wire drawing and the second wire drawing may be performed in series.

[7] Second Heat Treatment (Solution Heat Treatment)

The second heat treatment is performed on the work piece that has been subjected to wire drawing. The second heat treatment is a solution heat treatment for dissolving randomly contained compounds of Mg and Si into an aluminum matrix. With the solution heat treatment, it is possible to even out the Mg and Si concentration parts during a working (it homogenizes) and leads to a suppression in the segregation a Mg component and a Si component at grain boundaries after the final aging heat treatment. The second heat treatment is specifically a heat treatment including heating to a predetermined temperature in a range of 450° C. to 600° C. at a temperature increasing rate of 100° C./s, retaining for a retention time of 30 seconds or less, and thereafter cooling at an average cooling rate of greater than or equal to 10° C./s to a temperature of at least to 150° C. In a case where the temperature increasing rate is less than 100° C./s, the grain size becomes coarse. When a predetermined temperature during the second heat treatment temperature is higher than 540° C., the grain size becomes coarse and abnormal growth grains are produced, and in a case where the predetermined temperature is lower than 450° C., $Mg_2Si$ cannot be made into a solid solution. Therefore, the predetermined temperature during the heating in the second heat treatment is in a range of 450° C. to 600° C., and although it may vary depending on the content of Mg and Si, preferably in a range of 450° C. to 540° C., and more preferably in a range of 480° C. to 520° C.

A method of performing the second heat treatment may be, for example, batch heat treatment, salt bath, or may be continuous heat treatment such as high-frequency heating, conduction heating, and running heating.

In a case where high-frequency heating and conduction heating are used, the wire rod temperature increases with a passage of time, since it normally has a structure in which an electric current continues to flow through the wire rod. Accordingly, since the wire rod may melt when an electric current continues to flow through, it is necessary to perform heat treatment for an appropriate time range. In a case where running heating is used, since it is an annealing in a short time, the temperature of a running annealing furnace is usually set higher than a wire rod temperature. Since the wire rod may melt with a heat treatment over a long time, it is necessary to perform heat treatment in an appropriate time range. Also, all heat treatments require at least a predetermined time period in which an Mg—Si compound contained randomly in the work piece will be dissolved into an aluminum matrix. Hereinafter, the heat treatment by each method will be described.

The continuous heat treatment by high-frequency heating is a heat treatment by joule heat generated from the wire rod itself by an induced current by the wire rod continuously passing through a magnetic field caused by a high frequency. Steps of rapid heating and quenching are included, and the wire rod can be heat-treated by controlling the wire rod temperature and the heat treatment time. The cooling is performed after rapid heating by continuously allowing the wire rod to pass through water or in a nitrogen gas atmosphere. This heat treatment time is 0.01 s to 2 s, preferably 0.05 s to 1 s, and more preferably 0.05 s to 0.5 s.

The continuous conducting heat treatment is a heat treatment by joule heat generated from the wire rod itself by allowing an electric current to flow in the wire rod that continuously passes two electrode wheels. Steps of rapid heating and quenching are included, and the wire rod can be heat-treated by controlling the wire rod temperature and the heat treatment time. The cooling is performed after rapid heating by continuously allowing the wire rod to pass through water, atmosphere or a nitrogen gas atmosphere. This heat treatment time period is 0.01 s to 2 s, preferably 0.05 s to 1 s, and more preferably 0.05 s to 0.5 s.

A continuous running heat treatment is a heat treatment in which the wire rod continuously passes through a heat treatment furnace maintained at a high-temperature. Steps of rapid heating and quenching are included, and the wire rod can be heat-treated by controlling the temperature in the heat treatment furnace and the heat treatment time. The cooling is performed after rapid heating by continuously allowing the wire rod to pass through water, atmosphere or a nitrogen gas atmosphere. This heat treatment time period is 0.5 s to 30 s.

In a case where at least one of the wire rod temperature and the heat treatment time is lower than the condition defined above, the solution heat treatment will be incomplete, and solute atom clusters and a β"phase and a $Mg_2Si$ precipitate produced during the aging heat treatment, which is a post-process, will decrease, and an amount of increase in the tensile strength, the shock resistance, the bending fatigue resistance and the conductivity becomes small. In a case where at least one of the wire rod temperature and the annealing time is higher than the condition specified above, the crystal grains will be coarse and a partial fusion (eutectic fusion) of a composition phase of an aluminum alloy wire rod occurs, and the tensile strength and the elongation will decrease, and a wire break is likely to occur during the handing of the conductor.

[8] Third Heat Treatment (Aging Heat Treatment)

Subsequently, a third heat treatment is applied. The third heat treatment is an aging heat treatment performed for producing solute atom clusters. In the aging heat treatment, the heating temperature is preferably 20° C. to 150° C. In a case where the heating temperature is lower than 20° C., the production of the solute atom cluster is slow and requires time to obtain necessary tensile strength and elongation, and thus it is disadvantageous for mass-production. In a case where the heating temperature is higher than 150° C., an amount of produced solute atom cluster decreases, and a large number of $Mg_2Si$ needle-like precipitates (β" phase) that reduces elongation is produced. In order to produce solute atom cluster that has an effect of improving elongation, the heating temperature in the aging heat treatment is preferably 20 to 70° C.

In order for the β" phase to precipitate at the same time, and for a balance between the tensile strength and the elongation, 100 to 125° C. is preferable. Also, as for the heating time period, the optimum heating period may vary depending on the temperature. In order to improve the tensile strength and the elongation, and to reduce the 0.2% yield strength to tensile strength, a long heating time is preferable at a low temperature and a short heating time is preferable at a high temperature. For example, a long heating time is ten days or less, and, a short heating time is, preferably, 15 hours or less, and more preferably, 8 hours or less. It is to be noted that, in order to prevent dispersion of the properties, it is preferable to increase the cooling rate as much as possible. Of course, even in a case where cooling cannot be performed quickly due to the manufacturing process, it can be appropriately set if it is an aging condition with which solute atom clusters are produced sufficiently.

A strand diameter of the aluminum alloy wire rod of the present embodiment is not particularly limited and can be determined as appropriate depending on an application, and it is preferably 0.1 mm to 0.5 mm ϕ for a fine wire, and 0.8 mm to 1.5 mm ϕ for a case of a middle sized wire. The aluminum alloy wire rod of the present embodiment is advantageous in that it can be used as a thin single wire as an aluminum alloy wire, but may also be used as an aluminum alloy stranded wire obtained by stranding a plurality of them together, and among the aforementioned steps [1] to [8] of the manufacturing method of the present disclosure, after bundling and stranding a plurality of aluminum alloy wire rods obtained by sequentially performing each of steps [1] to [6], the steps of [7] second heat treatment and [8] aging heat treatment may be performed.

Also, with the present embodiment, homogenizing heat treatment performed in the prior art may be performed as a further additional step after the continuous casting rolling. Since a homogenizing heat treatment makes it possible to uniformly disperse the added elements, it becomes easy to uniformly produce crystallized substances, and in the subsequent third heat treatment, a solute atom cluster and β" phase, and an improvement in a tensile strength, an elongation, a value of yield strength to tensile strength can be obtained more stably. The homogenizing heat treatment is preferably performed at a heating temperature of 450° C. to 600° C., and more preferably 500° C. to 600° C. Also, as for the cooling in the homogenizing heat treatment, a slow cooling at an average cooling rate of 0.1° C./min to 10° C./min is preferable since it becomes easier to obtain a uniform compound.

With the aluminum alloy wire rod manufactured by the method described above, considering an impact to be experienced during wire harness installation, the tensile strength is greater than or equal to 200 MPa, and preferably greater than or equal to 250 MPa, and more preferably greater than or equal to 270 MPa. The elongation is greater than or equal to 13%, and preferably greater than or equal to 15%. The conductivity is greater than or equal to 47% IACS, and preferably greater than or equal to 48% IACS. Considering the ease of handling during wire harness installation, a ratio (YS/TS) of 0.2% yield strength (YS) to tensile strength (TS) is set at less than or equal to 0.7. The average grain size of the crystal grain is less than or equal to one-third of the wire size. Thereby, a small yield strength to tensile strength and a good balance between the tensile strength, the elongation and the conductivity can be achieved, and an aluminum wire rod for a wire harness is provided having a good routing and handling property.

The aluminum alloy wire rod of the present disclosure can be used as an aluminum alloy wire, or as an aluminum alloy stranded wire obtained by stranding a plurality of aluminum alloy wires, and may also be used as a coated wire having a coating layer at an outer periphery of the aluminum alloy wire or the aluminum alloy stranded wire, and, in addition, it can also be used as a wire harness having a coated wire and a terminal fitted at an end portion of the coated wire, the coating layer being removed from the end portion.

EXAMPLES

The present disclosure will be described in detail based on the following examples. Note that the present disclosure is not limited to examples described below.

Examples and Comparative Examples

Mg, Si, Fe, Ni and Al, and selectively added Ti, B, Mn and Cr are placed in a Properzi-type continuous casting rolling mill such that the contents (mass %) are as shown in Tables 1-1 and 1-2, and a molten metal containing these raw materials was continuously cast with a water-cooled mold in said Properzi-type continuous casting rolling mill and rolled into a bar of approximately ϕ 9.5 mm. A casting cooling rate at this time was approximately 15° C./s. Then, a first wire drawing was applied to obtain a predetermined reduction ratio. Then, a first heat treatment was performed on a work piece subjected to the first wire drawing, and thereafter, a second wire drawing was performed with a reduction ratio similar to the first wire drawing until a wire size of ϕ 0.31 mm. Then, a second heat treatment was applied under conditions shown in Tables 2-1 and 2-2. In the first heat treatment, in a case of a batch heat treatment, a wire rod temperature was measured with a thermocouple wound around the wire rod. In a case of consecutive running heat treatment in the first and second heat treatment, a wire rod temperature in the vicinity of a heat treatment section outlet was measured. After the second heat treatment, an aging heat treatment was applied under conditions shown in Tables 2-1 and 2-2 to produce an aluminum alloy wire.

For each of aluminum alloy wires of the Example and the Comparative Example, each characteristic was measured by methods shown below. The results are shown in Tables 2-1 and 2-2.

(A) Measurement of Tensile Strength (TS), Elongation After Fracture (El), and Yield Strength (0.2% Yield Strength/Tensile Strength)

In conformity with JIS Z2241, a tensile test was carried out for three materials under test (aluminum alloy wires) each time, and an average value thereof was obtained. The tensile strength of greater than or equal to 200 MPa was regarded as acceptable so as maintain a tensile strength of a crimped portion at a connecting portion between the electric wire and the terminal, and to withstand a load abruptly applied during an installation work to a car body. As for the elongation, an elongation after fracture of greater than or equal to 13% was regarded as acceptable. The ratio of the yield strength to the tensile strength (0.2% yield strength) of less than 0.5 was regarded as acceptable for efficiency of an installation work to a car body. Note that, in Tables 2-1 and 2-2, "A" indicates that the tensile strength is greater than or equal to 250 MPa and the 0.2% yield strength (YS)/tensile strength (TS) is less than 0.5; "B" indicates that the tensile strength is greater than or equal to 200 MPa and the 0.2% yield strength/tensile strength is less than 0.5; and "C" indicates that the tensile strength is greater than or equal to 200 MPa and the 0.2% yield strength/tensile strength is less than or equal to 0.7.

(B) Conductivity (EC)

In a constant temperature bath in which a test piece of 300 mm in length is held at 20° C. (±0.5° C.), a resistivity was measured for three materials under test (aluminum alloy wires) each time using a four terminal method, and an average conductivity was calculated. The distance between the terminals was 200 mm. The conductivity of greater than or equal to 47% IACS was regarded as an acceptable level.

(C) Analysing and Measuring Methods of Solute Atom Clusters and β" Phase

Differential scanning calorimetry (DSC) was performed and in a predetermined temperature range (0 to 400° C.), a DSC curve as shown in FIG. 1 was obtained. Then, in a range of 150 to 200° C., a point on the curve indicating the highest heating value was obtained (temperature T0, calorific value V0), was obtained, and a temperature axis was drawn in parallel through this point, and the calorific value V0 represented by this straight line was taken as a reference calorific value, and point Pmin indicating a lowest peak with respect to this straight line was determined (temperature T1, calorific value V1), and an absolute value |V0−V1| of a difference between the reference calorific value V0 and the calorific value V1 was determined. In a case where this absolute value is greater than or equal to 0.5 μW/g, and preferably greater than or equal to 1.0 μW/g, it was determined that solute atom clusters sufficient for satisfying the properties of the present embodiment are produced.

Also, a point Pmax indicating the highest peak with respect to the straight line representing the above-mentioned reference calorific value V0 was determined (temperature T2; V2), and an absolute value |V0-V2| of a difference between the reference calorific value V0 and the calorific value V2 was determined. In a case where this absolute value is greater than or equal to 50 μW/g and less than or equal to 1000 μW/g, preferably less than or equal to 500 μW/g, it was determined that β" phase sufficient for satisfying the properties of the present embodiment are produced.

That is, with the aforementioned absolute value of greater than or equal to 50 μW/g, a predetermined elongation and a 0.2% yield strength are ensured. When it is less than or equal to 1000 μW/g, and preferably less than or equal to 500 μW/g, a sufficient tensile strength is ensured. In the present embodiment, the solute atom clusters and β" phase were measured and analyzed using a DSC analyzer device (manufactured by Hitachi High-Tech Science Corporation, device name "X-DSC7000") and in a heat flow velocity mode, sample quantity 5 to 20 mg, a rate of temperature increase of 10 to 40° C./min.

TABLE 1-1

| | | Composition wt % | | | | | | | | | | | | | | | | | |
|---|---|---|---|---|---|---|---|---|---|---|---|---|---|---|---|---|---|---|---|
| | No. | Mg | Si | Fe | Cu | Ag | Au | Ni | Mn | Cr | Zr | Hf | V | Sc | Co | Ti | B | Al | Mg/Si |
| EX- | 1 | 0.10 | 0.18 | 0.70 | | | 0.10 | | | | | | | | | 0.010 | 0.005 | Bal- | 0.6 |
| AM- | 2 | 0.10 | 0.25 | 1.00 | | | | | | | | 0.10 | | | | | | ance | 0.4 |
| PLE | 3 | 0.20 | 0.30 | 0.50 | | | | | | | | | | 0.10 | | 0.050 | 0.025 | | 0.7 |
| | 4 | 0.20 | 0.35 | | | | | | | | | | | | 0.10 | 0.010 | 0.005 | | 0.6 |
| | 5 | 0.20 | 0.50 | 0.20 | 0.05 | 0.05 | | | | | | | | | | | | | 0.4 |
| | 6 | 0.30 | 0.38 | 0.70 | 0.05 | | | 0.10 | | | | | | | | 0.010 | 0.005 | | 0.8 |
| | 7 | 0.30 | 0.50 | 0.20 | 0.05 | | | | 0.10 | | | | 0.05 | | | 0.010 | 0.005 | | 0.6 |
| | 8 | 0.30 | 0.60 | 0.70 | 0.05 | | | | | | 0.05 | | | | | 0.010 | 0.005 | | 0.5 |
| | 9 | 0.30 | 0.75 | | 0.10 | | | | | | | 0.05 | | | | | | | 0.4 |
| | 10 | 0.35 | 0.44 | 0.01 | 0.10 | | | | | | | | 0.05 | | | 0.010 | 0.005 | | 0.8 |
| | 11 | 0.35 | 0.53 | 0.20 | 0.10 | | | | | | | | | 0.05 | | 0.010 | 0.005 | | 0.7 |
| | 12 | 0.35 | 0.70 | 0.70 | 0.10 | | | | | | | | | | 0.05 | 0.010 | 0.005 | | 0.5 |
| | 13 | 0.35 | 0.87 | 0.20 | 0.50 | | | | | | | | | | | | | | 0.4 |
| | 14 | 0.40 | 0.50 | 0.20 | | | | 0.05 | 0.05 | 0.05 | | | | | | 0.010 | 0.005 | | 0.8 |
| | 15 | 0.40 | 0.60 | 0.10 | | | | 0.05 | 0.05 | | | | | | | 0.010 | 0.005 | | 0.7 |
| | 16 | 0.40 | 0.70 | 0.20 | | | | 0.05 | 0.01 | | | | | | | 0.010 | 0.005 | | 0.6 |
| | 17 | 0.40 | 0.80 | 0.30 | | | | 0.05 | | 0.50 | | | | | | 0.010 | 0.005 | | 0.5 |
| | 18 | 0.45 | 0.57 | 0.20 | | | | 0.05 | | | 0.50 | | | | | 0.010 | 0.005 | | 0.8 |
| | 19 | 0.45 | 0.60 | 0.20 | | | | 0.05 | 0.10 | | | | | | | 0.030 | 0.015 | | 0.8 |
| | 20 | 0.45 | 0.80 | 0.10 | | | | 0.05 | | 0.10 | | | | | | 0.010 | 0.005 | | 0.6 |
| | 21 | 0.45 | 0.90 | 0.20 | | | | 0.10 | | | | | | | | 0.010 | 0.005 | | 0.5 |
| | 22 | 0.50 | 0.63 | 0.20 | | | | 0.10 | | | 0.10 | | | | | 0.020 | 0.010 | | 0.8 |
| | 23 | 0.50 | 0.75 | 0.20 | | | | 0.10 | | | | | | | | 0.010 | 0.005 | | 0.7 |
| | 24 | 0.50 | 0.80 | 0.10 | | | | 0.10 | | | | | | | | 0.002 | 0.001 | | 0.6 |
| | 25 | 0.50 | 1.00 | 0.30 | | | | 0.10 | | 0.01 | | | | | | 0.010 | 0.005 | | 0.5 |
| | 26 | 0.55 | 0.70 | 0.20 | | | | 0.50 | | | | | | | | | | | 0.8 |
| | 27 | 0.55 | 0.85 | 0.20 | | | | | 0.50 | | | | | | | 0.010 | 0.005 | | 0.6 |
| | 28 | 0.55 | 1.10 | 0.20 | | | | | 0.10 | | | | 0.10 | | | 0.020 | 0.010 | | 0.5 |
| | 29 | 0.60 | 0.75 | 0.20 | | | | | | | 0.05 | | 0.10 | | | | | | 0.8 |
| | 30 | 0.60 | 0.90 | 0.50 | | | | 0.10 | | | 0.05 | | | | | 0.010 | 0.005 | | 0.7 |
| | 31 | 0.60 | 1.20 | 0.20 | | | | | | | 0.05 | | | | 0.05 | 0.010 | 0.005 | | 0.5 |
| | 32 | 0.70 | 0.38 | 0.01 | | | | | | | | | | | | | | | 0.8 |
| | 33 | 0.80 | 1.00 | 0.20 | | | | | | | 0.50 | | | | | | | | 0.8 |

TABLE 1-2

| | No. | Mg | Si | Fe | Cu | Ag | Au | Ni | Mn | Cr | Zr | Hf | V | Sc | Co | Ti | B | Al | Mg/Si |
|---|---|---|---|---|---|---|---|---|---|---|---|---|---|---|---|---|---|---|---|
| | | Composition wt % | | | | | | | | | | | | | | | | | |
| COM- | 1 | 0.60 | 0.60 | 0.30 | | | | | 0.10 | 0.08 | | | | | | 0.030 | 0.002 | Bal- | ***1.00*** |
| PARA- | 2 | 0.67 | 0.52 | 0.13 | | | | | | 0.20 | | | | | | 0.020 | 0.004 | ance | ***1.29*** |
| TIVE | 3 | 1.00 | ***1.35*** | 0.50 | | | | | | | | | | | | 0.001 | 0.001 | | 0.74 |
| EX - | 4 | ***1.20*** | 1.20 | 0.30 | | | | | | | | | | | | 0.010 | 0.005 | | 1.00 |
| AM- | 5 | 0.60 | 0.90 | 0.50 | | | | 0.10 | | | 0.05 | | | | | 0.010 | 0.005 | | 0.67 |
| PLE | 6 | 0.60 | 0.75 | ***1.50*** | 0.10 | | | | | | | | | | | 0.010 | 0.005 | | 0.80 |
| | 7 | 0.60 | 0.90 | 0.20 | | | | | | | ***0.80*** | | ***0.80*** | | | 0.010 | 0.005 | | 0.67 |
| | 8 | 0.60 | 1.20 | 0.20 | | | | | | ***0.80*** | | ***0.70*** | | | | 0.010 | 0.005 | | 0.50 |
| | 9 | 0.70 | 0.88 | 0.20 | ***0.80*** | | | | ***0.80*** | | | | | | | 0.010 | 0.005 | | 0.80 |

N.B. NUMERICAL VALLES IN BOLD ITALIC IN THE TABLE ARE OUT OF APPROPRIATE RANGE OF EXAMPLE

TABLE 2-1

| | No. | SOLUTION HEAT TREATMENT STEP ANNEALING METHOD | TEMP. ° C. | TIME sec | AGING TREATMENT STEP TEMP. ° C. | TIME h | CLUSTER ENDO-THERMIC PEAK μW/g | β"-PHASE EXO-THERMIC PEAK μW/g | TENSILE STRENGTH Mpa | ELON-GA-TION % | 0.2% YIELD STRENGTH TENSILE STRENGTH (Ys/Ts) — | CON-DUC-TIVITY % IACS | EVAL-UATION |
|---|---|---|---|---|---|---|---|---|---|---|---|---|---|
| EX- | 1 | RUNNING | 520 | 10 | 150 | 3 | 1 | 960 | 215 | 13 | 0.7 | 51 | C |
| AM- | 2 | RUNNING | 540 | 5 | 150 | 6 | 40 | 900 | 200 | 15 | 0.61 | 48 | C |
| PLE | 3 | SALT BATH | 540 | 20 | 130 | 6 | 60 | 850 | 205 | 17 | 0.57 | 51 | C |
| | 4 | RUNNING | 600 | 5 | 130 | 12 | 80 | 920 | 200 | 19 | 0.47 | 57 | B |
| | 5 | RUNNING | 600 | 10 | 130 | 24 | 120 | 840 | 215 | 20 | 0.46 | 55 | B |
| | 6 | RUNNING | 600 | 20 | 100 | 6 | 110 | 950 | 235 | 18 | 0.45 | 47 | B |
| | 7 | RUNNING | 600 | 30 | 100 | 12 | 140 | 830 | 220 | 21 | 0.47 | 51 | B |
| | 8 | RUNNING | 600 | 40 | 100 | 24 | 150 | 760 | 270 | 17 | 0.42 | 47 | A |
| | 9 | BATCH | 460 | 600 | 100 | 48 | 90 | 800 | 235 | 19 | 0.5 | 53 | C |
| | 10 | BATCH | 460 | 3600 | 70 | 12 | 100 | 800 | 205 | 16 | 0.45 | 52 | B |
| | 11 | SALT BATH | 480 | 600 | 70 | 24 | 120 | 820 | 210 | 18 | 0.46 | 49 | B |
| | 12 | BATCH | 480 | 3600 | 70 | 48 | 130 | 770 | 240 | 20 | 0.45 | 51 | B |
| | 13 | BATCH | 540 | 600 | 70 | 72 | 155 | 700 | 260 | 22 | 0.45 | 46 | A |
| | 14 | RUNNING | 500 | 20 | 70 | 10 | 90 | 850 | 215 | 17 | 0.47 | 49 | B |
| | 15 | RUNNING | 500 | 20 | 70 | 10 | 110 | 870 | 200 | 18 | 0.49 | 50 | B |
| | 16 | RUNNING | 500 | 20 | 100 | 10 | 100 | 750 | 235 | 18 | 0.48 | 51 | B |
| | 17 | RUNNING | 500 | 20 | 100 | 10 | 70 | 730 | 260 | 19 | 0.47 | 45 | A |
| | 18 | RUNNING | 500 | 20 | 130 | 10 | 45 | 600 | 280 | 13 | 0.55 | 48 | C |
| | 19 | RUNNING | 500 | 20 | 130 | 10 | 65 | 650 | 230 | 14 | 0.56 | 52 | C |
| | 20 | BATCH | 580 | 1800 | 70 | 10 | 150 | 630 | 245 | 19 | 0.42 | 48 | B |
| | 21 | BATCH | 580 | 1800 | 70 | 10 | 170 | 700 | 235 | 20 | 0.44 | 47 | B |
| | 22 | BATCH | 580 | 1800 | 100 | 10 | 100 | 600 | 240 | 17 | 0.47 | 49 | B |
| | 23 | BATCH | 580 | 1800 | 100 | 10 | 140 | 620 | 235 | 18 | 0.5 | 49 | C |
| | 24 | BATCH | 580 | 1800 | 130 | 10 | 110 | 550 | 250 | 16 | 0.52 | 53 | C |

TABLE 2-2

| | No. | SOLUTION HEAT TREATMENT STEP ANNEALING METHOD | TEMP. ° C. | TIME sec | AGING TREAT-MENT STEP TEMP. ° C. | TIME h | CLUS-TER ENDO-THER-MIC PEAK μW/g | β"-PHASE EXO-THER-MIC PEAK μW/g | TENSILE STRENGTH Mpa | ELON-GA-TION % | 0.2% YIELD STRENGTH TENSILE STRENGTH (Ys/Ts) — | CON-DUC-TIVITY % IACS | EVAL-UA-TION |
|---|---|---|---|---|---|---|---|---|---|---|---|---|---|
| EX- | 22 | BATCH | 580 | 1800 | 100 | 10 | 100 | 600 | 240 | 17 | 0.47 | 49 | B |
| AM- | 23 | BATCH | 580 | 1500 | 100 | 10 | 140 | 620 | 235 | 18 | 0.5 | 49 | C |
| PLE | 24 | BATCH | 580 | 1800 | 130 | 10 | 110 | 550 | 250 | 16 | 0.52 | 53 | C |
| | 25 | SALT BATH | 580 | 1800 | 130 | 10 | 115 | 550 | 260 | 17 | 0.51 | 50 | C |
| | 26 | CONDUCTION | 580 | 0.1 | 70 | 10 | 115 | 580 | 270 | 19 | 0.44 | 45 | A |
| | 27 | CONDUCTION | 580 | 0.1 | 100 | 10 | 115 | 450 | 280 | 16 | 0.47 | 46 | A |
| | 28 | CONDUCTION | 580 | 0.1 | 130 | 10 | 95 | 400 | 285 | 15 | 0.52 | 50 | C |
| | 29 | BATCH | 600 | 600 | 50 | 24 | 175 | 710 | 290 | 18 | 0.45 | 45 | A |

TABLE 2-2-continued

| | No. | SOLUTION HEAT TREATMENT STEP ANNEALING METHOD | TEMP. ° C. | TIME sec | AGING TREATMENT STEP TEMP. ° C. | TIME h | CLUSTER ENDOTHERMIC PEAK μW/g | β"-PHASE EXOTHERMIC PEAK μW/g | TENSILE STRENGTH Mpa | ELONGATION % | 0.2% YIELD STRENGTH TENSILE STRENGTH (Ys/Ts) — | CONDUCTIVITY % IACS | EVALUATION |
|---|---|---|---|---|---|---|---|---|---|---|---|---|---|
| | 30 | BATCH | 600 | 7200 | 70 | 48 | 190 | 550 | 300 | 19 | 0.43 | 46 | A |
| | 31 | BATCH | 560 | 600 | 100 | 72 | 185 | 580 | 260 | 21 | 0.4 | 45 | A |
| | 32 | CONDUCTION | 500 | 0.05 | 20 | 120 | 80 | 550 | 210 | 14 | 0.54 | 49 | C |
| | 33 | CONDUCTION | 520 | 0.30 | 150 | 3 | 30 | 90 | 330 | 13 | 0.62 | 48 | C |
| COMPARATIVE EXAMPLE | 1 | RUNNING | 570 | 20 | 160 | 20 | NOT OBSERVABLE | 80 | 325 | ***11*** | ***0.75*** | ***42*** | NG |
| | 2 | BOX FURNACE | 530 | 10800 | 250 | 8 | NOT OBSERVABLE | 50 | ***157*** | ***8*** | ***0.80*** | 52 | NG |
| | 3 | CONDUCTION | 540 | 0 | 50 | 24 | 140 | 150 | 320 | 15 | 0.44 | ***31*** | NG |
| | 4 | RUNNING | 540 | 10 | 150 | 6 | 15 | 30 | 350 | ***3*** | ***0.85*** | 50 | NG |
| | 5 | BATCH | 600 | 7200 | 200 | 10 | NOT OBSERVABLE | 70 | 330 | ***12*** | 0.55 | 49 | NG |
| | 6 | WIRE BROKE DURING WIRE DRAWING | | | | | WIRE BROKE DURING DRAWING | | | WIRE BROKE DURING DRAWING | | | NG |
| | 7 | BATCH | 540 | 600 | 130 | 12 | 65 | 400 | 340 | ***11*** | 0.55 | ***36*** | NG |
| | 8 | BATCH | 540 | 600 | 50 | 24 | 165 | 640 | 350 | 18 | 0.44 | ***25*** | NG |
| | 9 | BATCH | 540 | 600 | 50 | 24 | 140 | 480 | 360 | 17 | 0.46 | ***26*** | NG |

N.B. NUMERICAL VALUES IN BOLD ITALIC IN THE TABLE ARE OUT OF APPROPRIATE RANGE OF EXAMPLE

From the results in Tables 2-1 and 2-2, the following is elucidated. The aluminum alloy wire of Examples 1 to 33 each had a tensile strength, an elongation and conductivity with a good balance, and had an improved yield strength (0.2% yield strength) to the tensile strength. Specifically, with Examples 1-3, 9, 18, 19, 23-25, 28, 32 and 33, Si was 0.10 to 1.20 mass %, solute atom clusters were produced by a low temperature aging heat treatment, and a tensile strength of greater than or equal to 200 MPa, a 0.2% yield strength/tensile strength less than or equal to 0.7, an elongation of greater than or equal to 13%, and a conductivity of 45% IACS were achieved. Also, with Examples 4-7, 10-12, 14-16, 20, 21, and 22, Si was 0.10 to 1.20 mass %, an amount of solute atom clusters produced was increased by a low temperature aging heat treatment, and 0.2% yield strength/tensile strength of less than or equal to 0.5 was achieved. With Examples 8, 13, 17, 26, 27, 29, 20 and 31, Si was 0.10 to 1.20 mass %, an amount of solute atom clusters and β" phase produced was controlled by a low temperature aging heat treatment, and also adding second additional elements, a tensile strength of greater than or equal to 250 MPa and a 0.2% yield strength/tensile strength of less than 0.5 were achieved.

In contrast, an aluminum alloy wire of Comparative Example 1 had a Mg/Si mass ratio of 1.0, and the conductivity was low, and the 0.2% yield strength (YS)/tensile strength (TS) was high, and thus poor in ease of routing and handling of an electric wire and conductivity. An aluminum alloy wire of Comparative Example 2 had a Mg/Si mass ratio of 1.29, the yield strength/tensile strength was high and the ease of routing and handling of an electric wire was poor. An aluminum alloy wire of Comparative Example 3 had an excessive Si, and had a poor conductivity. An aluminum alloy wire of Comparative Example 4 had an excessive Mg, a Mg/Si mass ratio of 1.00, the yield strength/tensile strength was high and the ease of routing and handling of an electric wire was poor. An aluminum alloy wire of Comparative Example 5 had a high temperature during annealing heat treatment, and elongation was poor. An aluminum alloy wire of Comparative Example 6 had an excessive Fe, and the wire broke during wire drawing. An aluminum alloy wire of Comparative Example 7 had both an excessive Fe and an excessive V, and elongation and conductivity were poor. An aluminum alloy wire of Comparative Example 8 had both an excessive Cr and an excessive Hf, and conductivity was poor. An aluminum alloy wire of Comparative Example 9 had both an excessive Cu and an excessive Mn, and conductivity was poor.

An aluminum alloy wire rod of the present disclosure is based on the premise that an aluminum alloy containing Mg and Si is used, and it is possible to provide an aluminum alloy wire rod used as a conductor of an electric wiring structure, an aluminum alloy stranded wire, a coated wire, and a wire harness, having an improved ease of routing and handling while ensuring a good balance between tensile strength, elongation and conductivity, even if used as an extra fine wire having a wire diameter of less than or equal to 0.5 mm, and to provide a method of manufacturing an aluminum alloy wire rod, and it is also useful as a battery cable, a harness or a lead wire for motor that are installed in mobile bodies, and an electric wiring structure for industrial robots. Further, since the aluminum alloy wire rod of the present disclosure has a high tensile strength, it is possible to make the wire size smaller than that of the conventional electric wire, and also, since it has an improved ease of routing and handling, a work efficiency for attaching to a car body can be improved. Particularly, for wire harnesses, a range of application of electric wires using an aluminum alloy wire rod tends to increase, and particularly contributes to an increase in a range of application to a door harness which requires a high strength and a high ease of routing and handling.

What is claimed is:

1. An aluminum alloy wire rod having a composition comprising Mg: 0.10 mass % to 1.0 mass %, Si: 0.10 mass % to 1.20 mass %, Fe: 0.01 mass % to 1.40 mass %, Ti:

0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, the aluminum alloy wire rod having a tensile strength of greater than or equal to 200 MPa, an elongation of greater than or equal to 13%, a conductivity of greater than or equal to 47% IACS, and a ratio (YS/TS) of 0.2% yield strength (YS) to the tensile strength (TS) of less than or equal to 0.7.

2. The aluminum alloy wire rod according to claim 1, wherein the composition contains at least one selected from a group comprising Ti: 0.001 mass % to 0.100 mass % and B: 0.001 mass % to 0.030 mass %.

3. The aluminum alloy wire rod according to claim 1, wherein the composition contains at least one selected from a group comprising Cu: 0.01 mass % to 1.00 mass %, Ag: 0.01 mass % to 0.50 mass %, Au: 0.01 mass % to 0.50 mass %, Mn: 0.01 mass % to 1.00 mass %, Cr: 0.01 mass % to 1.00 mass %, Zr: 0.01 mass % to 0.50 mass %, Hf: 0.01 mass % to 0.50 mass %, V: 0.01 mass % to 0.50 mass %, Sc: 0.01 mass % to 0.50 mass %, Co: 0.01 mass % to 0.50 mass %, and Ni: 0.01 mass % to 0.50 mass %.

4. The aluminum alloy wire rod according to claim 1, wherein the composition contains Ni: 0.01 mass % to 0.50 mass %.

5. The aluminum alloy wire rod according to claim 1, wherein a total of contents of Fe, Ti, B, Cu, Ag, Au, Mn, Cr, Zr, Hf, V, Sc, Co, and Ni is 0.01 mass % to 2.00 mass %.

6. The aluminum alloy wire rod according to claim 1, wherein the aluminum alloy wire rod is an aluminum alloy wire having a diameter of 0.1 mm to 0.5 mm.

7. An aluminum alloy stranded wire comprising a plurality of aluminum alloy wires as claimed in claim 6 which are stranded together.

8. A coated wire comprising a coating layer at an outer periphery of one of the aluminum alloy wire as claimed in claim 6.

9. A wire harness comprising:

a coated wire including a coating layer at an outer periphery of one of an aluminum alloy wire rod and an aluminum alloy stranded wire; and a terminal fitted at an end portion of the coated wire, the coating layer being removed from the end portion, wherein the aluminum alloy wire rod has a composition comprising Mg: 0.10 mass % to 1.0 mass %, Si: 0.10 mass % to 1.20 mass %, Fe: 0.01 mass % to 1.40 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, the aluminum alloy wire rod having a tensile strength of greater than or equal to 200 MPa, an elongation of greater than or equal to 13%, a conductivity of greater than or equal to 47% IACS, and a ratio (YS/TS) of 0.2% yield strength (YS) to the tensile strength (TS) of less than or equal to 0.7.

10. A method of manufacturing an aluminum alloy wire rod having a composition comprising Mg: 0.10 mass % to 1.0 mass %, Si: 0.10 mass % to 1.20 mass %, Fe: 0.01 mass % to 1.40 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, the aluminum alloy wire rod having a tensile strength of greater than or equal to 200 MPa, an elongation of greater than or equal to 13%, a conductivity of greater than or equal to 47% IACS, and a ratio (YS/TS) of 0.2% yield strength (YS) to the tensile strength (TS) of less than or equal to 0.7, the method comprising:

forming a drawing stock through hot working subsequent to melting and casting, and thereafter carrying out processes including at least a wire drawing process, a solution heat treatment process and an aging heat treatment process, the solution heat treatment process including heating to a predetermined temperature in a range of 450° C. to 540° C. at a temperature increasing rate of greater than or equal to 100° C./s, retaining for a retention time of 30 seconds or less, and thereafter cooling at an average cooling rate of greater than or equal to 10° C./s at least to a temperature of 150° C., and the aging heat treatment process including heating to a predetermined temperature in a range of 20° C. to 150° C. at a temperature increasing temperature in a range of 20° C./s to 100° C./s.

11. An aluminum alloy wire rod having a composition comprising Mg: 0.10 mass % to 1.00 mass %, Si: 0.10 mass % to 1.20 mass %, Fe: 0.01 mass % to 0.70 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, a solute atom cluster being present in the aluminum alloy wire rod.

12. The aluminum alloy wire rod according to claim 11, wherein a β"-phase is present in the aluminum alloy wire rod.

13. The aluminum alloy wire rod according to claim 11, wherein the composition contains at least one selected from a group comprising Ti: 0.001 mass % to 0.100 mass % and B: 0.001 mass % to 0.030 mass %.

14. The aluminum alloy wire rod according to claim 11, wherein the composition contains at least one selected from a group comprising Cu: 0.01 mass % to 1.00 mass %, Ag: 0.01 mass % to 0.50 mass %, Au: 0.01 mass % to 0.50 mass %, Mn: 0.01 mass % to 1.00 mass %, Cr: 0.01 mass % to 1.00 mass %, Zr: 0.01 mass % to 0.50 mass %, Hf: 0.01 mass % to 0.50 mass %, V: 0.01 mass % to 0.50 mass %, Sc: 0.01 mass % to 0.50 mass %, Co: 0.01 mass % to 0.50 mass %, and Ni: 0.01 mass % to 0.50 mass %, and an average crystal grain size is less than or equal to ⅓ of a wire size.

15. The aluminum alloy wire rod according to claim 11, wherein the composition contains Ni: 0.01 mass % to 0.50 mass %.

16. The aluminum alloy wire rod according to claim 11, wherein the aluminum alloy wire rod has a tensile strength of greater than or equal to 200 MPa, an elongation of greater than or equal to 13%, a conductivity of greater than or equal to 45% IACS, and a ratio (YS/TS) of 0.2% yield strength (YS) to the tensile strength (TS) of less than or equal to 0.7.

17. The aluminum alloy wire rod according to claim 11, wherein the aluminum alloy wire rod is an aluminum alloy wire having a diameter of 0.1 mm to 0.5 mm.

18. An aluminum alloy stranded wire comprising a plurality of aluminum alloy wires as claimed in claim 17 which are stranded together.

19. A coated wire comprising a coating layer at an outer periphery of one of the aluminum alloy wire as claimed in claim 11.

20. A wire harness comprising:

a coated wire including a coating layer at an outer periphery of one of an aluminum alloy wire rod and an aluminum alloy stranded wire; and a terminal fitted at an end portion of the coated wire, the coating layer being removed from the end portion, wherein the aluminum alloy wire rod has a composition comprising Mg: 0.10 mass % to 1.00 mass %, Si: 0.10 mass % to 1.20 mass %, Fe: 0.01 mass % to 0.70 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, a solute atom cluster being present in the aluminum alloy wire rod.

21. A method of manufacturing an aluminum alloy wire rod having a composition comprising Mg: 0.10 mass % to 1.00 mass %, Si: 0.10 mass % to 1.20 mass %, Fe: 0.01 mass % to 0.70 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, a solute atom cluster being present in the aluminum alloy wire rod, the method comprising:

forming a drawing stock through hot working subsequent to melting, casting, and homogenizing heat treatment, and thereafter carrying out processes including at least a wire drawing process, a solution heat treatment process and an aging heat treatment process, the solution heat treatment process including heating to a predetermined temperature in a range of 450° C. to 600° C. at a temperature increasing rate of greater than or equal to 10° C./s, and thereafter cooling at an average cooling rate of greater than or equal to 10° C./s at least to a temperature of 150° C., and the aging heat treatment process including heating to a predetermined temperature in a range of 20° C. to 150° C. at a temperature increasing temperature in a range of 0.5° C./s to 130° C./s.

22. An aluminum alloy wire rod having a composition comprising Mg: 0.10 mass % to 1.00 mass %, Si: 0.10 mass % to 1.20 mass %, Fe: 0.01 mass % to 0.70 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, a Differential Scanning calorimetry curve having an endothermic peak corresponding to fusion of a solute atom cluster.

23. The aluminum alloy wire rod according to claim 22, wherein, on the Differential Scanning calorimetry curve, a maximum amount of heat in a range of 150° C. to 200° C. is taken as a reference amount of heat, and an absolute value of a difference between the reference amount of heat and an amount of heat of the endothermic peak corresponding to fusion of a solute atom cluster in a range of 150° C. to 250° C. is greater than or equal to 1.0 μW/g.

24. The aluminum alloy wire rod according to claim 22, wherein, an endothermic peak corresponding to production of a β"-phase is produced on the Differential Scanning calorimetry curve.

25. The aluminum alloy wire rod according to claim 24, wherein, on the Differential Scanning calorimetry curve, a maximum amount of heat in a range of 150° C. to 200° C. is taken as a reference amount of heat, and an absolute value of a difference between the reference amount of heat and an amount of heat of the endothermic peak corresponding to production of a β"-phase in a range of 200° C. to 350° C. is less than or equal to 1000 μW/g.

26. The aluminum alloy wire rod according to claim 22, wherein the composition contains at least one selected from a group comprising Ti: 0.001 mass % to 0.100 mass % and B: 0.001 mass % to 0.030 mass %.

27. The aluminum alloy wire rod according to claim 22, wherein the composition contains at least one selected from a group comprising Cu: 0.01 mass % to 1.00 mass %, Ag: 0.01 mass % to 0.50 mass %, Au: 0.01 mass % to 0.50 mass %, Mn: 0.01 mass % to 1.00 mass %, Cr: 0.01 mass % to 1.00 mass %, Zr: 0.01 mass % to 0.50 mass %, Hf: 0.01 mass % to 0.50 mass %, V: 0.01 mass % to 0.50 mass %, Sc: 0.01 mass % to 0.50 mass %, Co: 0.01 mass % to 0.50 mass %, and Ni: 0.01 mass % to 0.50 mass %, and an average crystal grain size is less than or equal to ⅓ of a wire size.

28. The aluminum alloy wire rod according to claim 22, wherein the composition contains Ni: 0.01 mass % to 0.50 mass %.

29. The aluminum alloy wire rod according claim 22, wherein the aluminum alloy wire rod has a tensile strength of greater than or equal to 200 MPa, an elongation of greater than or equal to 13%, a conductivity of greater than or equal to 45% IACS, and a ratio (YS/TS) of 0.2% yield strength (YS) to the tensile strength (TS) of less than or equal to 0.7.

30. The aluminum alloy wire rod according to claim 22, wherein the aluminum alloy wire rod is an aluminum alloy wire having a diameter of 0.1 mm to 0.5 mm.

31. An aluminum alloy stranded wire comprising a plurality of aluminum alloy wires as claimed in claim 30 which are stranded together.

32. A coated wire comprising a coating layer at an outer periphery of the aluminum alloy wire as claimed in claim 22.

33. A wire harness comprising:

a coated wire including a coating layer at an outer periphery of one of aluminum alloy wire rod and an aluminum alloy stranded wire; and a terminal fitted at an end portion of the coated wire, the coating layer being removed from the end portion, wherein the aluminum alloy wire rod has a composition comprising Mg: 0.10 mass % to 1.00 mass %, Si: 0.10 mass % to 1.20 mass %, Fe: 0.01 mass % to 0.70 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, a Differential Scanning calorimetry curve having an endothermic peak corresponding to fusion of a solute atom cluster.

34. A method of manufacturing an aluminum alloy wire rod having a composition comprising Mg: 0.10 mass % to 1.00 mass %, Si: 0.10 mass % to 1.20 mass %, Fe: 0.01 mass % to 0.70 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, a Differential Scanning calorimetry curve having an endothermic peak corresponding to fusion of a solute atom cluster, the method comprising:

forming a drawing stock through hot working subsequent to melting, casting, and homogenizing heat treatment, and thereafter carrying out processes including at least a wire drawing process, a solution heat treatment process and an aging heat treatment process, the solution heat treatment process including heating to a predetermined temperature in a range of 450° C. to 600° C. at a temperature increasing rate of greater than or equal to 10° C./s, and thereafter cooling at an average cooling rate of greater than or equal to 10° C./s at least to a temperature of 150° C., and the aging heat treatment process including heating to a predetermined temperature in a range of 20° C. to 150° C. at a temperature increasing temperature in a range of 0.5° C./s to 130° C./s.

35. A method of measuring an aluminum alloy wire rod having a composition comprising Mg: 0.10 mass % to 1.0 mass %, Si: 0.10 mass % to 1.20 mass %, Fe: 0.01 mass % to 1.40 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, Mg/Si mass ratio being 0.4 to 0.8, wherein on a Differential Thermal Analysis curve, a maximum amount of heat in a range of 150° C. to 200° C. is taken as a reference amount of heat, and an absolute value of a difference between the reference amount of heat and a minimum amount of heat corresponding to an endothermic peak in a range of 150° C. to 250° C. is defined as a solute atom cluster production amount, and an absolute value of a difference between the reference amount of heat and a maximum amount of heat corresponding to an endothermic peak in a range of 200° C. to 350° C. is defined as β"-phase production amount.

* * * * *